US012357865B2

(12) United States Patent
Anderson

(10) Patent No.: US 12,357,865 B2
(45) Date of Patent: Jul. 15, 2025

(54) EXERCISE EQUIPMENT WITH DYNAMICALLY-ADJUSTABLE RESISTANCE

(71) Applicant: Joshua Anderson, Staten Island, NY (US)

(72) Inventor: Joshua Anderson, Staten Island, NY (US)

( * ) Notice: Subject to any disclaimer, the term of this patent is extended or adjusted under 35 U.S.C. 154(b) by 184 days.

(21) Appl. No.: 18/242,096

(22) Filed: Sep. 5, 2023

(65) Prior Publication Data

US 2025/0073519 A1 Mar. 6, 2025

(51) Int. Cl.
*A63B 21/00* (2006.01)
*A63B 24/00* (2006.01)

(52) U.S. Cl.
CPC ..... *A63B 21/00069* (2013.01); *A63B 21/154* (2013.01); *A63B 24/0087* (2013.01); *A63B 2213/00* (2013.01)

(58) Field of Classification Search
CPC ..... A63B 21/00069; A63B 21/0058; A63B 21/151; A63B 21/154; A63B 21/4035; A63B 21/4045; A63B 2022/206; A63B 24/0087; A63B 2024/0093; A63B 2213/00; A63B 2220/17; A63B 2220/51
See application file for complete search history.

(56) References Cited

U.S. PATENT DOCUMENTS

| | | | | |
|---|---|---|---|---|
| 7,278,958 | B2 | 10/2007 | Morgan | |
| 8,540,607 | B2 | 9/2013 | Kissel | |
| 8,968,155 | B2 | 3/2015 | Bird | |
| 9,403,048 | B2 | 8/2016 | Balandis | |
| 11,135,463 | B2 | 10/2021 | Rindfleisch | |
| D952,777 | S | 5/2022 | Horita | |
| 11,504,570 | B2 * | 11/2022 | Neuhaus | A63B 21/153 |
| 12,168,159 | B2 * | 12/2024 | Neuhaus | A63B 21/002 |
| 2006/0030459 | A1 * | 2/2006 | Piane | A63B 21/154 482/99 |
| 2006/0040801 | A1 * | 2/2006 | Piane | A63B 23/03525 482/93 |
| 2006/0160677 | A1 * | 7/2006 | Piane | A63B 23/03525 482/99 |

(Continued)

FOREIGN PATENT DOCUMENTS

| | | | | |
|---|---|---|---|---|
| FR | 2674136 | A1 * | 9/1992 | A63B 21/156 |
| WO | 2021262442 | | 12/2021 | |

*Primary Examiner* — Gary D Urbiel Goldner
(74) *Attorney, Agent, or Firm* — Kyle A. Fletcher, Esq.

(57) ABSTRACT

The exercise equipment with dynamically-adjustable resistance is a therapeutic device. The exercise equipment with dynamically-adjustable resistance is used by the patient for resistance exercises. The exercise equipment with dynamically-adjustable resistance presents a continuously adjustable resistance that acts as a counterforce for the patient. The exercise equipment with dynamically-adjustable resistance includes a load transfer structure, a load generating structure, and a control circuit. The control circuit and the load generating structure mount on the load transfer structure. The control circuit controls the measured value of the load presented to the patient. The load generating structure generates the load that is presented to the patient. The load transfer structure transfers the load generated by the load generating structure to the patient.

12 Claims, 6 Drawing Sheets

(56) References Cited

U.S. PATENT DOCUMENTS

| | | | | |
|---|---|---|---|---|
| 2012/0058859 | A1 | 3/2012 | Elsom-Cook | |
| 2016/0243396 | A1* | 8/2016 | Taylor | G09B 19/0038 |
| 2017/0252605 | A1* | 9/2017 | Siqueira | A63B 21/04 |
| 2021/0394011 | A1* | 12/2021 | Neuhaus | A63B 71/0622 |
| 2022/0040522 | A1* | 2/2022 | Rubino | A63B 21/4045 |
| 2023/0028361 | A1* | 1/2023 | Neuhaus | A63B 21/0058 |

* cited by examiner

EXERCISE EQUIPMENT WITH DYNAMICALLY-ADJUSTABLE RESISTANCE

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of methods of controlling loads for resistance exercise equipment. (A63B24/0087)

SUMMARY OF INVENTION

The exercise equipment with dynamically-adjustable resistance is a therapeutic device. The exercise equipment with dynamically-adjustable resistance is adapted for use with a patient. The exercise equipment with dynamically-adjustable resistance is used by the patient for resistance exercises. The exercise equipment with dynamically-adjustable resistance presents a continuously adjustable resistance that acts as a counterforce for the patient. The exercise equipment with dynamically-adjustable resistance comprises a load transfer structure, a load generating structure, and a control circuit. The control circuit and the load generating structure mount on the load transfer structure. The control circuit controls the measured value of the load presented to the patient. The load generating structure generates the load that is presented to the patient. The load transfer structure transfers the load generated by the load generating structure to the patient.

These together with additional objects, features and advantages of the exercise equipment with dynamically-adjustable resistance will be readily apparent to those of ordinary skill in the art upon reading the following detailed description of the presently preferred, but nonetheless illustrative, embodiments when taken in conjunction with the accompanying drawings.

In this respect, before explaining the current embodiments of the exercise equipment with dynamically-adjustable resistance in detail, it is to be understood that the exercise equipment with dynamically-adjustable resistance is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the exercise equipment with dynamically-adjustable resistance.

It is therefore important that the claims be regarded as including such equivalent construction insofar as they do not depart from the spirit and scope of the exercise equipment with dynamically-adjustable resistance. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
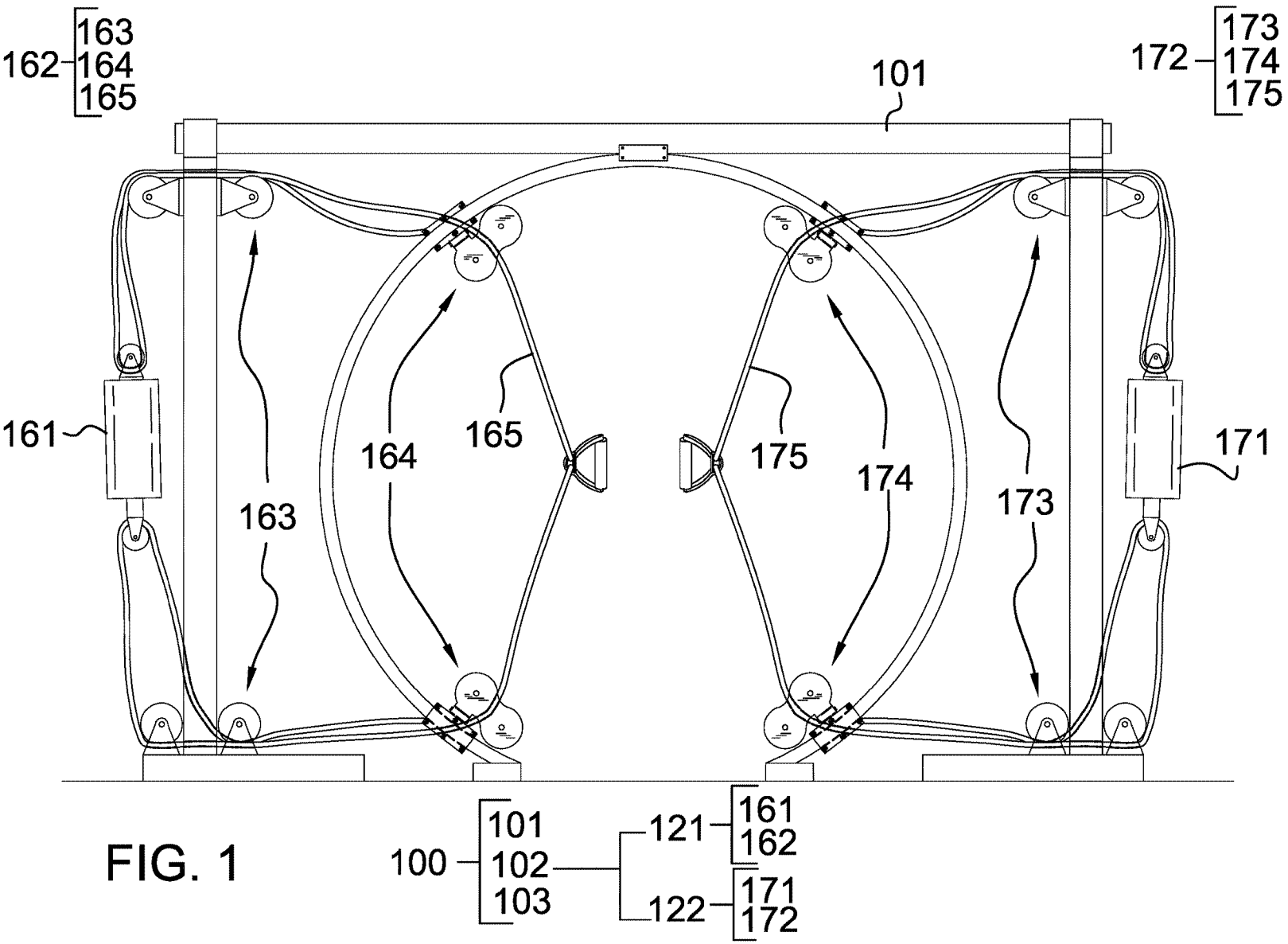
FIG. 1 is a front view of an embodiment of the disclosure.
Figure 2:
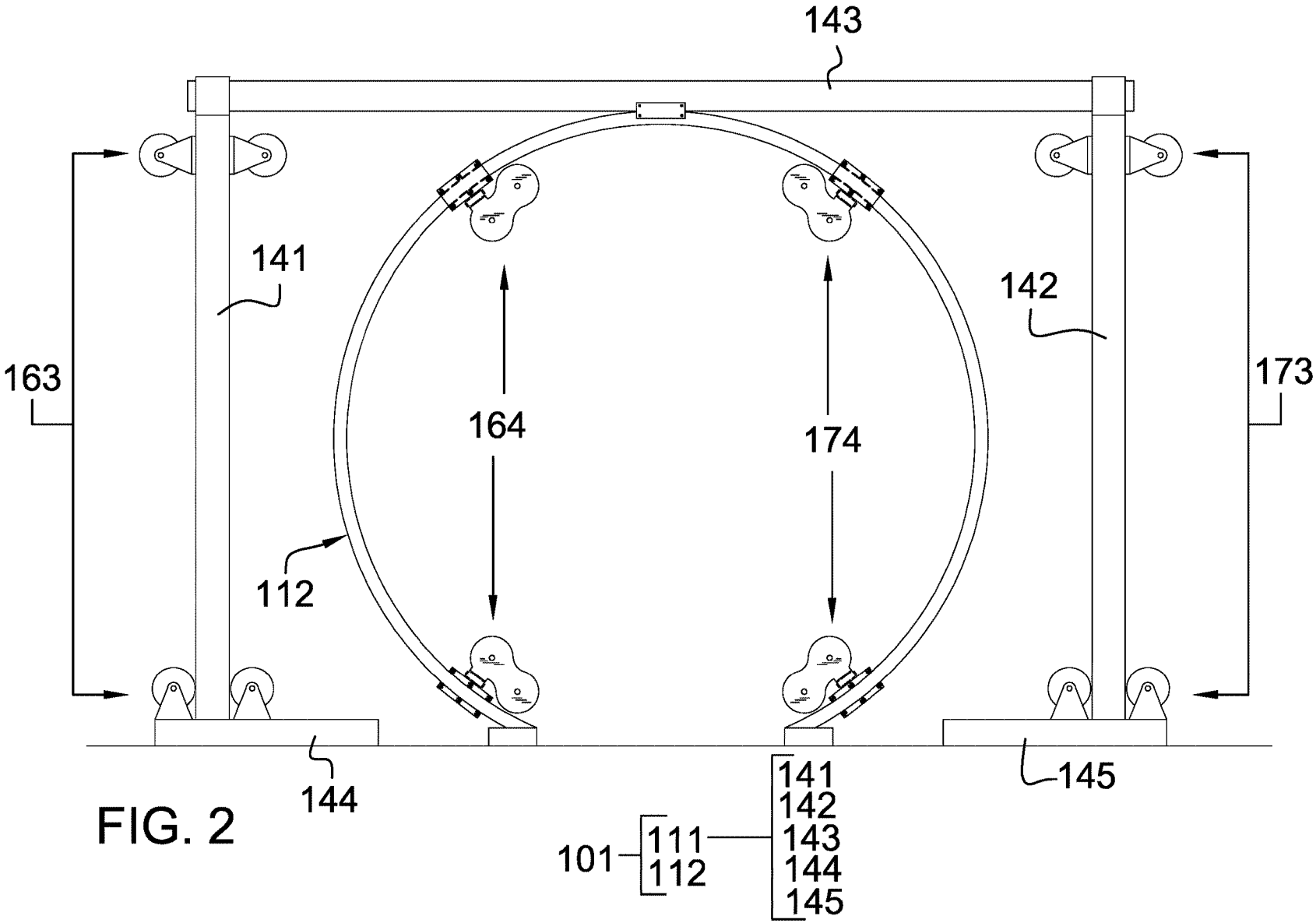
FIG. 2 is a rear view of an embodiment of the disclosure.
Figure 3:
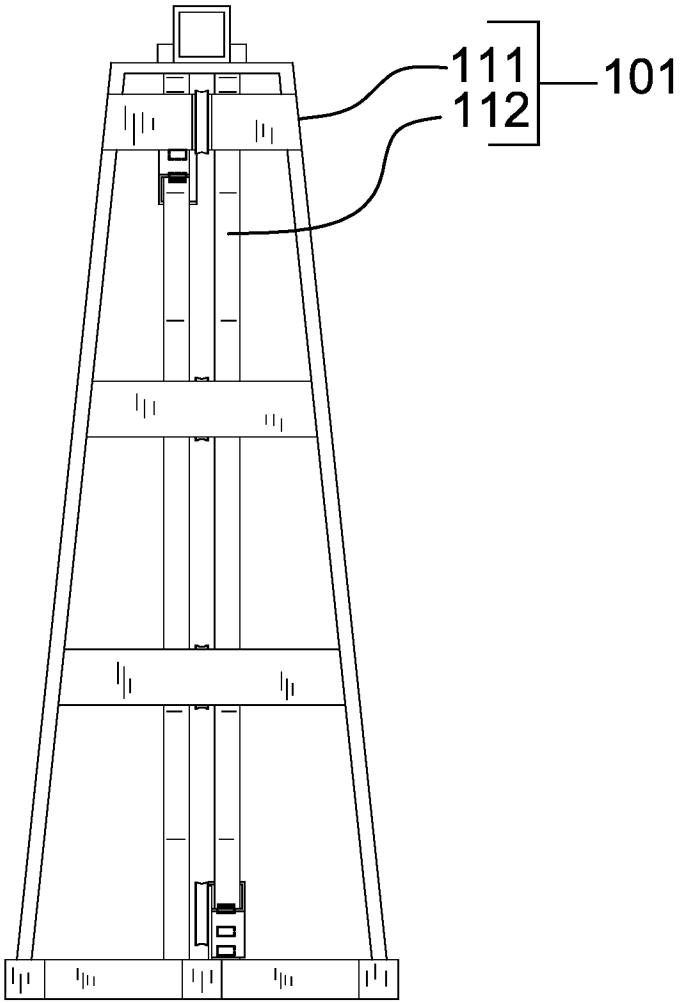
FIG. 3 is a side view of an embodiment of the disclosure.
Figure 4:
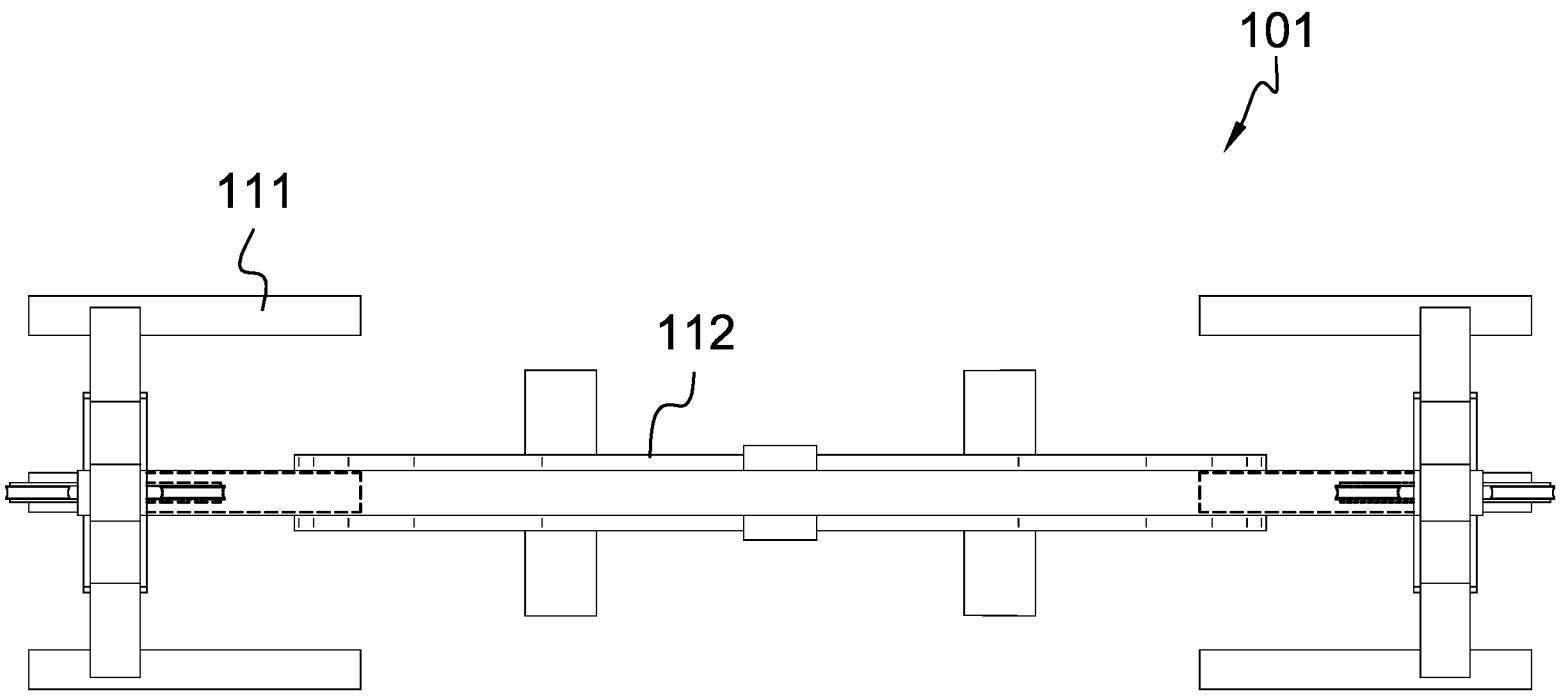
FIG. 4 is a top view of an embodiment of the disclosure.
Figure 5:
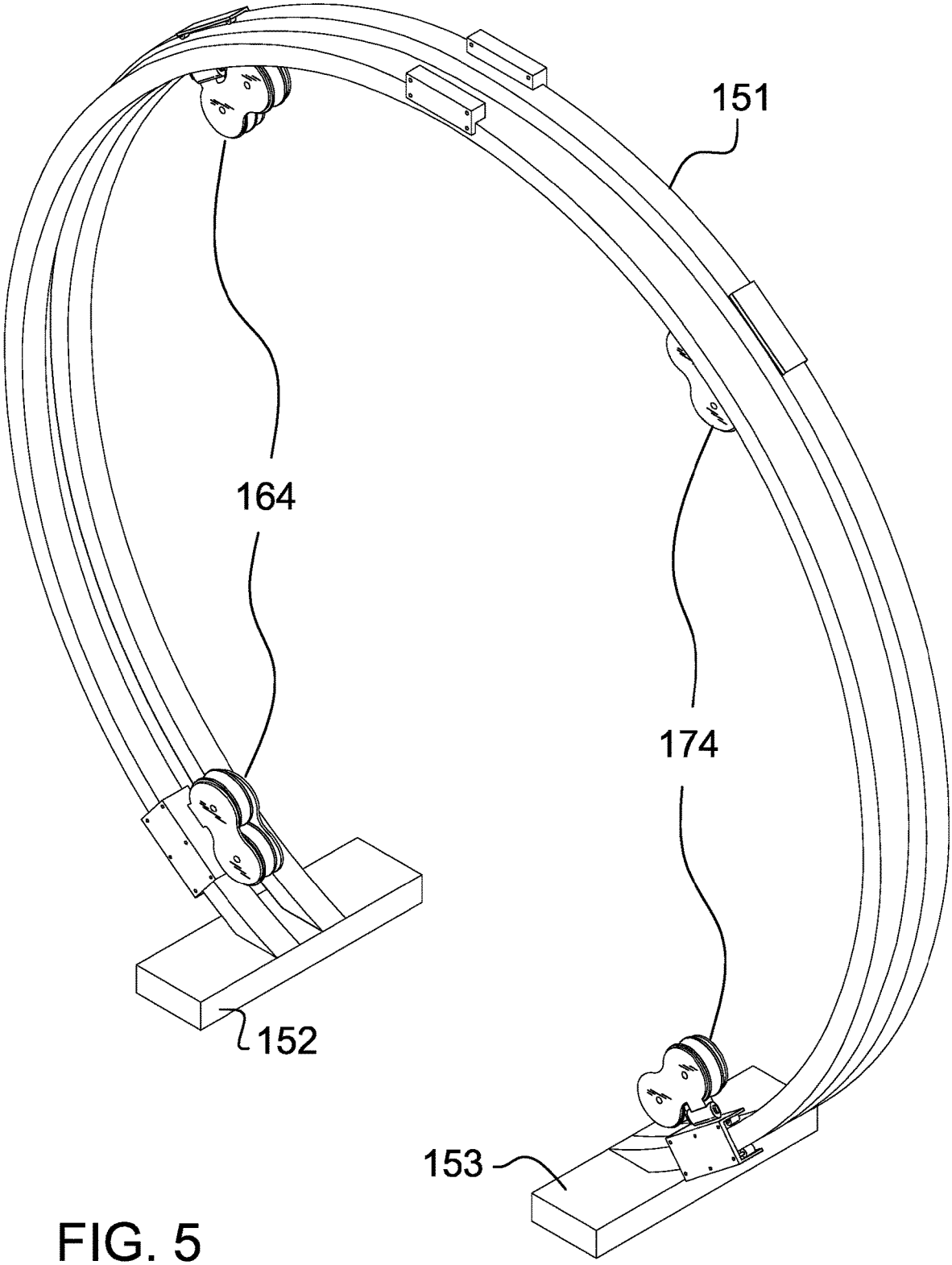
FIG. 5 is a perspective view of an embodiment of the disclosure.
Figure 6:
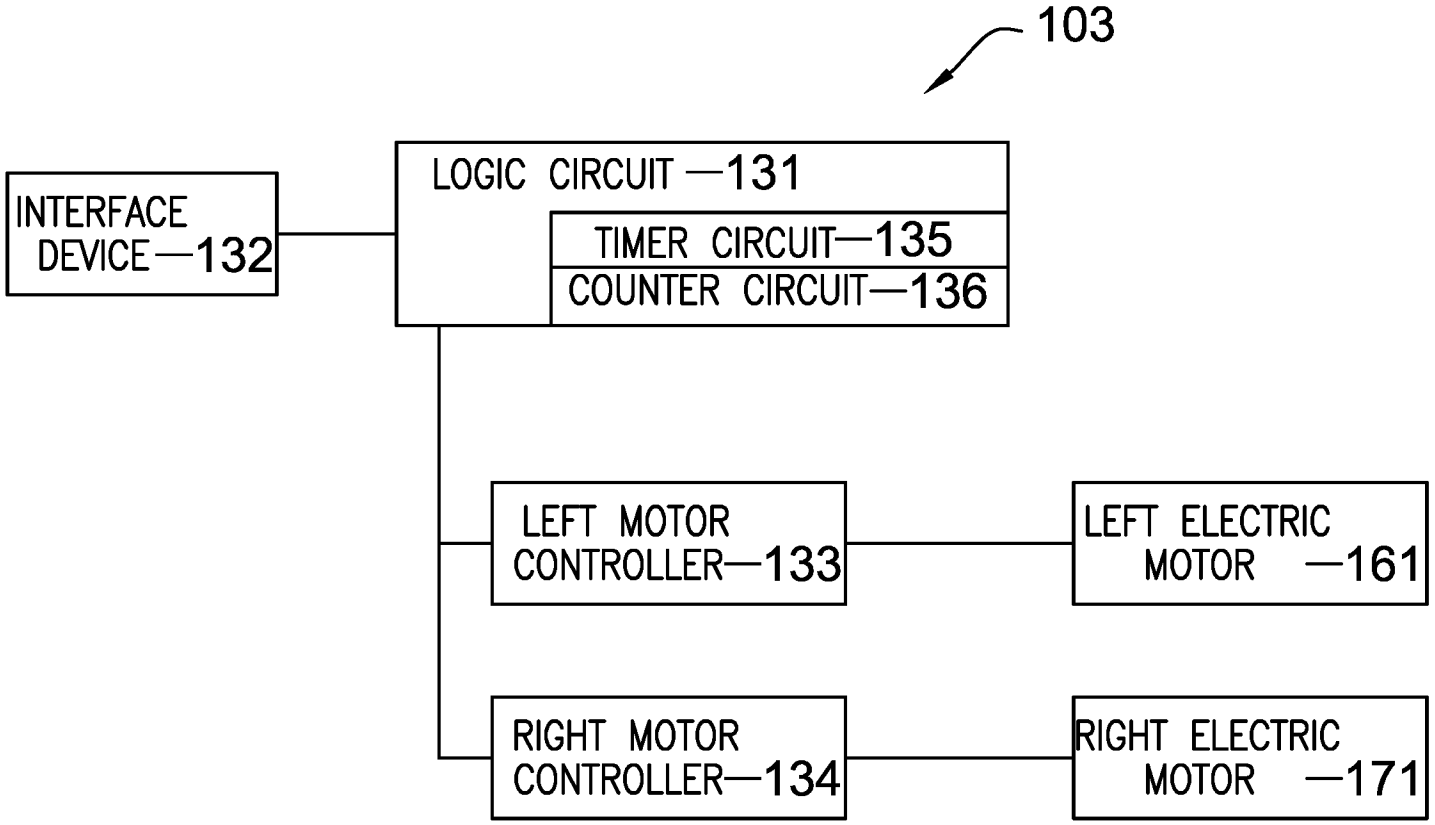
FIG. 6 is a schematic view of an embodiment of the disclosure.

Detailed reference will now be made to one or more potential embodiments of the disclosure, which are illustrated in FIGS. 1 through 6.

The exercise equipment with dynamically-adjustable resistance 100 (hereinafter invention) is a therapeutic device. The invention 100 is adapted for use with a patient. The invention 100 is used by the patient for resistance exercises. The invention 100 presents a continuously adjustable resistance that acts as a counterforce for the patient. The invention 100 comprises a load transfer structure 101, a load generating structure 102, and a control circuit 103. The control circuit 103 and the load generating structure 102 mount on the load transfer structure 101. The control circuit 103 controls the measured value of the load presented to the patient. The load generating structure 102 generates the load that is presented to the patient. The load transfer structure 101 transfers the load generated by the load generating structure 102 to the patient.

The load transfer structure 101 is a frame. The load transfer structure 101 is a rigid structure. The load transfer structure 101 is a load bearing structure. The load generating structure 102 and the control circuit 103 attach to the load transfer structure 101. The load transfer structure 101 transfers the load of the invention 100 to a supporting surface. The load transfer structure 101 transfers the load generated by the patient during exercise to the supporting surface. The load transfer structure 101 comprises an outer frame structure 111 and an inner ring structure 112.

The outer frame structure 111 is a rigid structure. The outer frame structure 111 is a rectilinear structure. The outer frame structure 111 is a load bearing structure. The outer frame structure 111 is formed as a composite prism structure.

The inner ring structure 112 attaches to the outer frame structure 111. A portion of the load generating structure 102 attaches to the outer frame structure 111. The outer frame structure 111 forms a load path that transfers a portion of the load borne by the inner ring structure 112 to the supporting surface. The outer frame structure 111 forms a load path that transfers a portion of the load borne by the load generating structure 102 to the supporting surface. The outer frame structure 111 forms a load path that transfers the counterforce generated by the load generating structure 102 to the inner ring structure 112. The outer frame structure 111 comprises a left stanchion 141, a right stanchion 142, and a support beam 143. The left stanchion 141 is a rigid structure. The left stanchion 141 is a prism shaped structure. The left stanchion 141 is a Euclidean structure. The left stanchion 141 forms a load bearing structure. The center axis of the left stanchion 141 is vertically oriented. The left stanchion 141 forms a stanchion that elevates the support beam 143 above the supporting surface. The superior congruent end of the left stanchion 141 attaches to a first congruent end of the support beam 143.

The left stanchion 141 further comprises a left pedestal structure 144. The inferior congruent end of the left stanchion 141 attaches to the lateral face of the prism structure of the left pedestal structure 144. The left stanchion 141 transfers the load of the support beam 143 to the left pedestal structure 144. The left pedestal structure 144 is a rigid structure. The left pedestal structure 144 is a prism shaped structure. The left pedestal structure 144 is a Euclidean structure. The left pedestal structure 144 is a load bearing structure. The left pedestal structure 144 forms the final link in the load path that transfers the load of the left stanchion 141 to the supporting surface.

The right stanchion 142 is a rigid structure. The right stanchion 142 is a prism shaped structure. The right stanchion 142 is a Euclidean structure. The right stanchion 142 forms a load bearing structure. The center axis of the right stanchion 142 is vertically oriented. The right stanchion 142 forms a stanchion that elevates the support beam 143 above the supporting surface. The superior congruent end of the right stanchion 142 attaches to a second congruent end of the support beam 143.

The right stanchion 142 further comprises a right pedestal structure 145. The inferior congruent end of the right stanchion 142 attaches to the lateral face of the prism structure of the right pedestal structure 145. The right stanchion 142 transfers the load of the support beam 143 to the right pedestal structure 145. The right pedestal structure 145 is a rigid structure. The right pedestal structure 145 is a prism shaped structure. The right pedestal structure 145 is a Euclidean structure. The right pedestal structure 145 is a load bearing structure. The right pedestal structure 145 forms the final link in the load path that transfers the load of the left stanchion 141 to the supporting surface.

The support beam 143 is a rigid structure. The support beam 143 is a prism shaped structure. The support beam 143 is a Euclidean structure. The support beam 143 forms a load bearing structure. The center axis of the support beam 143 is horizontally oriented. The support beam 143 attaches to the left stanchion 141 and the right stanchion 142 to form a u-shaped structure.

The inner ring structure 112 is a rigid structure. The inner ring structure 112 is a non-Euclidean prism structure. The inner ring structure 112 is a load bearing structure. The lateral face of the inner ring structure 112 attaches to the lateral face of the support beam 143 of the outer frame structure 111 to form a lateral disk structure. The inner ring structure 112 transfers a portion of the load borne by the inner ring structure 112 to the support beam 143 of the outer frame structure 111. The inner ring structure 112 transfers the balance of the load borne by the inner ring structure 112 to the supporting surface. The inner ring structure 112 receives the counterforce generated by the load generating structure 102 through the outer frame structure 111. The inner ring structure 112 presents the counterforce generated by the load generating structure 102 directly to the patient. The inner ring structure 112 comprises an inner ring perimeter 151, a left irp pedestal pad 152, and a right irp pedestal pad 153.

The inner ring perimeter 151 is a rigid structure. The inner ring perimeter 151 is a prism shaped structure. The inner ring perimeter 151 is a non-Euclidean prism structure. The inner ring perimeter 151 forms a load bearing structure. The inner ring perimeter 151 has the rough shape of a ring. The congruent ends of the inner ring perimeter 151 are not connected such that the characteristic aperture of a ring shape is not fully enclosed. The inner ring perimeter 151 transfers a portion of the load borne by the inner ring perimeter 151 to the support beam 143 of the load transfer structure 101. The inner ring perimeter 151 transfers the balance of the load borne by the inner ring perimeter 151 to the supporting surface. The patient accesses the counterforce presented by the load generating structure 102 from within the characteristic aperture of the inner ring perimeter 151.

The left irp pedestal pad 152 is a disk shaped structure. The left irp pedestal pad 152 is a rigid structure. The left irp pedestal pad 152 attaches to the lateral face of the inner ring perimeter 151. The left irp pedestal pad 152 attaches at a position proximal to the left congruent end of the inner ring perimeter 151. The left irp pedestal pad 152 transfers a portion of the load borne by the inner ring perimeter 151 directly to the supporting surface.

The right irp pedestal pad 153 is a disk shaped structure. The right irp pedestal pad 153 is a rigid structure. The right irp pedestal pad 153 attaches to the lateral face of the inner ring perimeter 151. The right irp pedestal pad 153 attaches at a position proximal to the right congruent end of the inner ring perimeter 151. The right irp pedestal pad 153 transfers a portion of the load borne by the inner ring perimeter 151 directly to the supporting surface.

The load generating structure 102 is an electromechanical device. The load generating structure 102 mounts on the load transfer structure 101. The load generating structure 102 generates the load that forms the counterforce that is presented to the patient during exercise. The load generating structure 102 controls the amount of counterforce that is presented to the patient. The load generating structure 102 controls the direction of the counterforce that is presented to the patient. The load generating structure 102 comprises a left lgs substructure 121 and a right lgs substructure 122.

The left lgs substructure 121 forms a first electromechanical substructure of the load generating structure 102. The left lgs substructure 121 is an electromechanical device. The left lgs substructure 121 mounts on the left side of the load transfer structure 101. The left lgs substructure 121 generates the load that forms the counterforce that is presented to the left side of the patient during exercise. The left lgs substructure 121 controls the amount of counterforce that is presented to the left side of the patient. The left lgs substructure 121 controls the direction of the counterforce that is presented to the left side of the patient. The left lgs substructure 121 comprises a left electric motor 161 and a left pulley track 162.

The left electric motor 161 is an electric motor. The left electric motor 161 converts electric energy into rotational energy. The left electric motor 161 generates the physical counterforce that is presented to the patient. The left electric motor 161 forms a mechanical linkage with the left pulley track 162. The left electric motor 161 transfers the generated counterforce to the patient through the left pulley track 162. The left pulley track 162 forms a mechanical linkage between the patient and the left electric motor 161. The left pulley track 162 transfers the counterforce generated by the left electric motor 161 to the left side of the patient. The left pulley track 162 further comprises a left outer frame pulley track 163, a left inner frame pulley track 164, and a left cable 165.

The left outer frame pulley track 163 comprises a third plurality of pulleys. The left outer frame pulley track 163 is formed with single pulleys. The left outer frame pulley track 163 mounts on the left stanchion 141 and the support beam 143 of the load transfer structure 101. The left outer frame pulley track 163 forms a track that guides the left cable 165 along the left stanchion 141 and the support beam 143.

The left inner frame pulley track 164 comprises a first plurality of pulleys. The left inner frame pulley track 164 is formed with double pulleys. The left inner frame pulley track 164 mount on the inner ring perimeter 151 of the inner ring structure 112. The left inner frame pulley track 164 forms a track that guides the left cable 165 along the inner ring perimeter 151 of the inner ring structure 112. Each pulley contained in the left inner frame pulley track 164 removably attaches to the inner ring perimeter 151 of the inner ring structure 112 such that the position of each pulley on the inner ring perimeter 151 is selectable. By selectable is meant that the position of the pulley can be selected to maximize the therapeutic benefit of any exercise being performed on the invention 100.

The left cable 165 is an energy transfer device. The left cable 165 attaches to the left electric motor 161. The left cable 165 routes through the left pulley track 162 to form a grip that is located within the characteristic aperture of the inner ring perimeter 151 of the inner ring structure 112 of the load transfer structure 101. The left cable 165 transfers the tension generated by the left electric motor 161 to the left side of the patient.

The right lgs substructure 122 forms a second electromechanical substructure of the load generating structure 102. The right lgs substructure 122 is an electromechanical device. The right lgs substructure 122 mounts on the right side of the load transfer structure 101. The right lgs substructure 122 generates the load that forms the counterforce that is presented to the right side of the patient during exercise. The right lgs substructure 122 controls the amount of counterforce that is presented to the right side of the patient. The right lgs substructure 122 controls the direction of the counterforce that is presented to the right side of the patient. The right lgs substructure 122 comprises a right electric motor 171 and a right pulley track 172.

The right electric motor 171 is an electric motor. The right electric motor 171 converts electric energy into rotational energy. The right electric motor 171 generates the physical counterforce that is presented to the patient. The right electric motor 171 forms a mechanical linkage with the right pulley track 172. The right electric motor 171 transfers the generated counterforce to the patient through the right pulley track 172. The right pulley track 172 forms a mechanical linkage between the patient and the right electric motor 171. The right pulley track 172 transfers the counterforce generated by the right electric motor 171 to the right side of the patient. The right pulley track 172 further comprises a right outer frame pulley track 173, a right inner frame pulley track 174, and a right cable 175.

The right outer frame pulley track 173 comprises a fourth plurality of pulleys. The right outer frame pulley track 173 is formed with single pulleys The right outer frame pulley track 173 mounts on the right stanchion 142 and the support beam 143 of the load transfer structure 101. The right outer frame pulley track 173 forms a track that guides the right cable 175 along the right stanchion 142 and the support beam 143.

The right inner frame pulley track 174 comprises a second plurality of pulleys. The right inner frame pulley track 174 is formed with double pulleys. The right inner frame pulley track 174 mount on the inner ring perimeter 151 of the inner ring structure 112. The right inner frame pulley track 174 forms a track that guides the right cable 175 along the inner ring perimeter 151 of the inner ring structure 112. Each pulley contained in the right inner frame pulley track 174 removably attaches to the inner ring perimeter 151 of the inner ring structure 112 such that the position of each pulley on the inner ring perimeter 151 is selectable. By selectable is meant that the position of the pulley can be selected to maximize the therapeutic benefit of any exercise being performed on the invention 100. The right cable 175 is an energy transfer device. The right cable 175 attaches to the right electric motor 171.

The right cable 175 routes through the right pulley track 172 to form a grip that is located within the characteristic aperture of the inner ring perimeter 151 of the inner ring structure 112 of the load transfer structure 101. The right cable 175 transfers the tension generated by the right electric motor 171 to the right side of the patient.

The control circuit 103 is an electric circuit. The control circuit 103 forms an interface with the patient. The control circuit 103 receives the desired amount of counterforce generated by the load generating structure 102 from the patient. The control circuit 103 counts the repetitions of each exercise performed by the patient. The control circuit 103 displays the number of repetitions to the patient through the interface.

The control circuit 103 electrically connects to the left electric motor 161 of the left lgs substructure 121. The control circuit 103 controls the operation of the left electric motor 161. By controlling the operation of the left electric motor 161 is meant that the control circuit 103 controls the amount of tension that is applied to the left cable 165 by the left electric motor 161. By controlling the operation of the left electric motor 161 is further meant that the control circuit 103 controls the direction of the tension that is applied to the left cable 165 by the left electric motor 161.

The control circuit 103 electrically connects to the right electric motor 171 of the right lgs substructure 122. The control circuit 103 controls the operation of the right electric motor 171. By controlling the operation of the right electric motor 171 is meant that the control circuit 103 controls the amount of tension that is applied to the right cable 175 by the right electric motor 171. By controlling the operation of the right electric motor 171 is further meant that the control circuit 103 controls the direction of the tension that is applied to the right cable 175 by the right electric motor 171.

The control circuit 103 comprises a logic circuit 131, an interface device 132, a left motor controller 133, and a right motor controller 134. The logic circuit 131, the interface device 132, the left motor controller 133, and the right motor controller 134 are electrically interconnected.

The logic circuit 131 is an electric circuit. The logic circuit 131 controls the operation of the load generating structure 102. The logic circuit 131 electrically connects to the interface device 132. The logic circuit 131 controls the operation of the interface device 132. The logic circuit 131 electrically connects to the left motor controller 133. The logic circuit 131 controls the operation of the left motor controller 133. The logic circuit 131 electrically connects to the right motor controller 134. The logic circuit 131 controls the operation of the right motor controller 134.

The logic circuit 131 further comprises a timer circuit 135 and a counter circuit 136. The timer circuit 135 is an electric circuit. The timer circuit 135 electrically connects to the logic circuit 131. The logic circuit 131 monitors the timer circuit 135. The logic circuit 131 uses the timer circuit 135 as a timing device that allows the logic circuit 131 to measure the amount of time required to perform each exercise repetition. The counter circuit 136 is an electric circuit. The counter circuit 136 forms an electric device that acts as a counter. The counter circuit 136 electrically connects to the logic circuit 131. The logic circuit 131 controls the operation of the counter circuit 136. The logic circuit 131 uses the counter circuit 136 to count the number of repetitions performed for each exercise.

The interface device 132 is an electric circuit. The interface device 132 forms an interface between the patient and the logic circuit 131. The logic circuit 131 receives the desired amount of counterforce generated by the load generating structure 102 through the interface device 132. The interface device 132 displays the number of repetitions of each exercise to the patient.

The left motor controller 133 is a motor controller. The motor controller is defined elsewhere in this disclosure. The left motor controller 133 receives operating instructions from the logic circuit 131 regarding the operation of the left electric motor 161 of the left lgs substructure 121. The left motor controller 133 electrically connects to the left electric motor 161. The left motor controller 133 controls the direction of rotation of the left electric motor 161. The left motor controller 133 controls the speed of rotation of the left electric motor 161. The left motor controller 133 measures the tension applied to the left cable 165 by the left electric motor 161. The left motor controller 133 adjusts the speed and direction of the rotation of the left electric motor 161 to maintain a tension on the left cable 165 that is consistent with the counterforce desired by the patient.

The right motor controller 134 is a motor controller. The motor controller is defined elsewhere in this disclosure. The right motor controller 134 receives operating instructions from the logic circuit 131 regarding the operation of the right electric motor 171 of the right lgs substructure 122. The right motor controller 134 electrically connects to the right electric motor 171. The right motor controller 134 controls the direction of rotation of the right electric motor 171. The right motor controller 134 controls the speed of rotation of the right electric motor 171. The right motor controller 134 measures the tension applied to the right cable 175 by the right electric motor 171. The right motor controller 134 adjusts the speed and direction of the rotation of the right electric motor 171 to maintain a tension on the right cable 175 that is consistent with the counterforce desired by the patient.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Beam: As used in this disclosure, a beam is a horizontally oriented load bearing structure.

Cable: As used in this disclosure, a cable is a cord formed from braided metal wires.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord.

Correspond: As used in this disclosure, the term correspond is used as a comparison between two or more objects wherein one or more properties shared by the two or more objects match, agree, or align within acceptable manufacturing tolerances.

Counter: As used in this disclosure, a counter refers to a device that maintains the count of a number of objects. A counter will increase the count in multiples of a fixed increment. A countdown counter refers to a counter that decreases count in multiples of the fixed increment.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Environment: As used in this disclosure, an environment refers to the physical conditions surrounding an object. The term environment is often limited to the physical conditions that the object interacts with.

Error Function: As used in this disclosure, an error function refers to a data structure that describes the difference between the actual result of a system and the expected results derived from: a) a mechanical or mathematical model of the system; or, b) a goal that is provided to the system from an external source.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exercise: As used in this disclosure, to exercise is a verb that refers to one or more physical activities that cause an individual to exert their muscles and organs such that the performance of the individual in the one or more physical activities will improve over a period of time. Each of the one or more physical activities are referred to as an exercise. Exercises are commonly classified as endurance exercises and strength training exercises. An endurance exercise focuses on improving the stamina and cardiovascular health of the individual. Strength exercises focus on improving the force, power, or work that can be generated from the muscles of the individual. A strength exercise that requires an individual to overcome an opposing force is referred to a resistance based exercise. Strength exercises are commonly classified as isometric exercises and isotonic exercises. An isometric exercise involves a motion that contracts the muscles of the individual without requiring the rotation of a joint of the individual. An isotonic exercise involves a motion that requires the rotation of a joint during the contraction of the muscle of the individual.

Exterior: As used in this disclosure, the exterior is used as a relational term that implies that an object is not contained within the boundary of a structure or a space.

Feedback: As used in this disclosure, feedback refers to a system, including engineered systems, or a subsystem further comprising an "input" and an "output" wherein the difference between the output of the engineered system or subsystem and a reference is used as, or fed back into, a portion of the input of the system or subsystem. Examples of feedback in engineered systems include, but are not limited to, a fluid level control device such as those typically used in a toilet tank, a cruise control in an automobile, a fly ball governor, a thermostat, and almost any electronic device that comprises an amplifier. Feedback systems in nature include, but are not limited to, thermal regulation in animals and blood clotting in animals (wherein the platelets involved in blood clotting release chemical to attract other platelets).

Force of Gravity: As used in this disclosure, the force of gravity refers to a vector that indicates the direction of the pull of gravity on an object at or near the surface of the earth.

Force Sensor: As used in this disclosure, the force sensor is a sensor that generates an electrically measurable signal that is a function of the amount of force applied to the force sensor. The force sensor is often referred to as a pressure sensor. The force sensor commonly measures force using the piezoelectric effect generated by the deformation of a material. A pressure sensor is a force sensor calibrated to measure force per unit area.

Force: As used in this disclosure, a force refers to a net (or unopposed) measurable interaction that changes the direction of motion of an object, the velocity of motion of an object, the momentum of an object, or the stress within an object. The term work refers to a measure of the amount of energy that is transferred through the application of a force over a distance. The term power refers to a measure of the amount of energy that is transferred over a period of time.

Form Factor: As used in this disclosure, the term form factor refers to the size and shape of an object.

Frame: As used in this disclosure, a frame is a structure or a first sub-structure: a) to which an object or a second sub-structure attaches; and, b) which forms a portion of the load path of the object or the second sub-structure.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interface: As used in this disclosure, an interface is a physical or virtual boundary that separates two different systems and across which information is exchanged.

Interior: As used in this disclosure, the interior is used as a relational term that implies that an object is contained within the boundary of a structure or a space.

Joint: As used in this disclosure, a joint refers to the attachment of a first bone of a body to a second bone of the body such that the first bone is able to rotate relative to the second joint.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mechanical Linkage: As used in this disclosure, a mechanical linkage is an interconnected arrangement of components that are used to manage the transfer of a movement or a force. A mechanical linkage is often referred to as a linkage.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Patient: As used in this disclosure, a patient is a person who is designated to receive a medical treatment, therapy, or service. The term patient may be extended to an animal when used within the context of the animal receiving veterinary treatment or services.

Pedestal: As used in this disclosure, a pedestal is an intermediary load bearing structure that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pulley: As used in this disclosure a pulley is a wheel with a grooved rim around which a cord (or other form of rope, line, or cable) passes. The pulley is used to change the direction of a force applied to the cord.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Rigid Structure: As used in this disclosure, a rigid structure is a solid structure formed from an inelastic material that resists changes in shape. A rigid structure will permanently deform as it fails under a force. See bimodal flexible structure.

Ring: As used in this disclosure, a ring is a term that is used to describe a disk-like structure through which a negative space is formed through the faces of the disk-like structure. Rings are often considered loops. The negative space formed through the faces of the disk-like structure is called the characteristic aperture.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Tension: As used in this disclosure, tension refers to a force applied to an object such that the force will increase the span of length of the object along the direction of the force.

Timing Circuit: As used in this disclosure, a timing circuit refers to an electrical network of interconnected electrical elements, potentially including but not limited to, resistors, capacitors, diodes, transistors, and integrated circuit devices. The purpose of the timing circuit is to generate an electrical control signal after a predetermined amount of time. In common usage, a timing circuit is also referred to as timing circuitry. The "555" timing circuit is a well-known, documented, and commercially available timing circuit.

Timing Device: As used in this disclosure, a timing device is an automatic mechanism for activating or deactivating a device at a specific time or after a specific period of time. This disclosure assumes that the logic module is provisioned with a timing circuit that can be used as a timing device. A timing device that activates an audible alarm is often referred to as a timer.

Therapeutic: As used in this disclosure, therapeutic is an adjective that refers to a medical, ameliorative, or hygienic substance, process, procedure, or device.

U-Shaped Structure: As used in this disclosure, a U-shaped structure is a type of offset composite prism structure. The U-shaped structure is a three sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of length of the first arm roughly equals the span of length of the second arm. An illiterate U-shaped structure refers to a U-shaped structure wherein the span of the length of the first arm differs from the span of the length of the second arm by more than 10 percent. A guided U-shaped structure refers to a U-shaped structure that has: a) the first arc formed by the interior cant formed between the first arm and the crossbeam is greater than or equal to 100 degrees; b) a second arc formed by the interior cant formed between the second arm and the crossbeam is greater than or equal to 100 degrees; and, c) the first arc and the second arc are roughly equal.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercise equipment with dynamically-adjustable resistance comprising:

a load transfer structure comprising:

an outer frame structure being rigid, rectilinear, and load bearing; and an inner ring structure being rigid, substantially ring-shaped, load bearing, and vertically oriented, the inner ring structure attached to and situated within the outer frame structure;

a control circuit; and a load generating structure comprising:

a left load generating substructure including a left electric motor, a left pulley track, and a left cable; and a right load generating substructure including a right electric motor, a right pulley track, and a right cable;

wherein an outer frame pulley track of each of the left and right pulley tracks is mounted on the outer frame structure and respectively guides the left and right cables along the outer frame structure;

wherein an inner frame pulley track of each of the left and right pulley tracks is mounted on the inner ring structure and respectively guides the left and right cables along the inner ring structure;

wherein the control circuit is mounted on the load transfer structure;

wherein the control circuit controls a measured value of a presented load; and wherein the load generating structure generates the presented load.

2. The exercise equipment with dynamically-adjustable resistance according to claim 1 wherein the exercise equipment with dynamically-adjustable resistance is a therapeutic device;

wherein the exercise equipment with dynamically-adjustable resistance presents a continuously adjustable resistance that acts as a counterforce.

3. The exercise equipment with dynamically-adjustable resistance according to claim 2 wherein the load transfer structure transfers the presented load of the exercise equipment with dynamically-adjustable resistance to a supporting surface.

4. The exercise equipment with dynamically-adjustable resistance according to claim 3 wherein the load generating structure generates the presented load that forms the presented counterforce;

wherein the load generating structure controls an amount of the presented counterforce;

wherein the load generating structure controls a direction of the presented counterforce.

5. The exercise equipment with dynamically-adjustable resistance according to claim 4 wherein the control circuit is an electric circuit;

wherein the control circuit forms an interface;

wherein the control circuit receives a desired amount of counterforce generated by the load generating structure through the interface;

wherein the control circuit displays a number of exercise repetitions through the interface;

wherein the control circuit electrically connects to the left electric motor of the left load generating substructure;

wherein the control circuit controls an operation of the left electric motor;

wherein controlling the operation of the left electric motor is meant that the control circuit controls an amount of tension that is applied to the left cable by the left electric motor;

wherein controlling the operation of the left electric motor is further meant that the control circuit controls a direction of the tension that is applied to the left cable by the left electric motor;

wherein the control circuit electrically connects to the right electric motor of the right load generating substructure;

wherein the control circuit controls an operation of the right electric motor;

wherein controlling the operation of the right electric motor is meant that the control circuit controls an amount of tension that is applied to the right cable by the right electric motor;

wherein controlling the operation of the right electric motor is further meant that the control circuit controls a direction of the tension that is applied to the right cable by the right electric motor.

6. The exercise equipment with dynamically-adjustable resistance according to claim 5 wherein the outer frame structure is formed as a composite structure;

wherein the outer frame structure forms a load path that transfers a portion of a load borne by the inner ring structure to the supporting surface;

wherein the outer frame structure forms a load path that transfers a portion of a load borne by the load generating structure to the supporting surface;

wherein the outer frame structure forms a load path that transfers the counterforce generated by the load generating structure to the inner ring structure;

wherein the inner ring structure is a non-Euclidean structure;

wherein a lateral face of the inner ring structure attaches to a lateral face of a support beam of the outer frame structure to form a lateral disk structure;

wherein the inner ring structure transfers the portion of the load borne by the inner ring structure to the support beam of the outer frame structure;

wherein the inner ring structure transfers a balance of the load borne by the inner ring structure to the supporting surface;

wherein the inner ring structure receives the counterforce generated by the load generating structure through the outer frame structure;

wherein the inner ring structure presents the counterforce generated by the load generating structure.

7. The exercise equipment with dynamically-adjustable resistance according to claim 6 wherein the outer frame structure comprises a left stanchion, a right stanchion, and the support beam;

wherein the left stanchion is a rigid structure;

wherein the left stanchion is a Euclidean structure;

wherein the left stanchion forms a load bearing structure;

wherein a center axis of the left stanchion is vertically oriented;

wherein the left stanchion forms a stanchion that elevates the support beam above the supporting surface;

wherein a superior congruent end of the left stanchion attaches to a first congruent end of the support beam;

wherein the right stanchion is a rigid structure;

wherein the right stanchion is a Euclidean structure;

wherein the right stanchion forms a load bearing structure;

wherein a center axis of the right stanchion is vertically oriented;

wherein the right stanchion forms a stanchion that elevates the support beam above the supporting surface;

wherein a superior congruent end of the right stanchion attaches to a second congruent end of the support beam;

wherein the support beam is a rigid structure;

wherein the support beam is a Euclidean structure;

wherein the support beam forms a load bearing structure;

wherein a center axis of the support beam is horizontally oriented;

wherein the support beam attaches to the left stanchion and the right stanchion to form a u-shaped structure.

8. The exercise equipment with dynamically-adjustable resistance according to claim 7 wherein the inner ring structure comprises an inner ring perimeter, a left inner ring perimeter pedestal pad, and a right inner ring perimeter pedestal pad;

wherein the inner ring perimeter is a rigid structure;

wherein the inner ring perimeter is a non-Euclidean structure;

wherein the inner ring perimeter forms a load bearing structure;

wherein the inner ring perimeter has a rough shape of a ring;

wherein left and right congruent ends of the inner ring perimeter are not connected such that a characteristic aperture of a ring shape is not fully enclosed;

wherein the inner ring perimeter transfers a portion of a load borne by the inner ring perimeter to the support beam of the load transfer structure;

wherein the inner ring perimeter transfers a balance of the load borne by the inner ring perimeter to the supporting surface;

wherein the left inner ring perimeter pedestal pad is a disk shaped structure;

wherein the left inner ring perimeter pedestal pad is a rigid structure;

wherein the left inner ring perimeter pedestal pad attaches to the lateral face of the inner ring perimeter;

wherein the left inner ring perimeter pedestal pad attaches at a position proximal to the left congruent end of the inner ring perimeter;

wherein the left inner ring perimeter pedestal pad transfers a portion of the load borne by the inner ring perimeter directly to the supporting surface;

wherein the right inner ring perimeter pedestal pad is a disk shaped structure;

wherein the right inner ring perimeter pedestal pad is a rigid structure;

wherein the right inner ring perimeter pedestal pad attaches to the lateral face of the inner ring perimeter;

wherein the right inner ring perimeter pedestal pad attaches at a position proximal to the right congruent end of the inner ring perimeter;

wherein the right inner ring perimeter pedestal pad transfers a portion of the load borne by the inner ring perimeter directly to the supporting surface.

9. The exercise equipment with dynamically-adjustable resistance according to claim 8 wherein the left load generating substructure forms a first electromechanical substructure of the load generating structure;

wherein the left load generating substructure is an electromechanical device;

wherein the left load generating substructure mounts on a left side of the load transfer structure;

wherein the right load generating substructure forms a second electromechanical substructure of the load generating structure;

wherein the right load generating substructure is an electromechanical device;

wherein the right load generating substructure mounts on a right side of the load transfer structure;

wherein the right load generating substructure generates the load that forms a portion of the presented counterforce;

wherein the right load generating substructure controls the amount of presented counterforce;

wherein the right load generating substructure controls the direction of the presented counterforce.

10. The exercise equipment with dynamically-adjustable resistance according to claim 9 wherein the control circuit comprises a logic circuit, an interface device, a left motor controller, and a right motor controller;

wherein the logic circuit, the interface device, the left motor controller, and the right motor controller are electrically interconnected.

11. The exercise equipment with dynamically-adjustable resistance according to claim 10 wherein the left electric motor converts electric energy into rotational energy;

wherein the left electric motor generates a portion of the presented counterforce;

wherein the left electric motor forms a mechanical linkage with the left pulley track;

wherein the left electric motor transfers the generated presented counterforce through the left pulley track;

wherein the left pulley track transfers the presented counterforce generated by the left electric motor;

wherein the right electric motor converts electric energy into rotational energy;

wherein the right electric motor generates a portion of the presented counterforce;

wherein the right electric motor forms a mechanical linkage with the right pulley track;

wherein the right electric motor transfers the generated presented counterforce through the right pulley track;

wherein the right pulley track transfers the presented counterforce generated by the right electric motor.

12. The exercise equipment with dynamically-adjustable resistance according to claim 11 wherein the logic circuit is an electric circuit;

wherein the logic circuit controls operation of the load generating structure;

wherein the logic circuit electrically connects to the interface device;

wherein the logic circuit controls operation of the interface device;

wherein the logic circuit electrically connects to the left motor controller;

wherein the logic circuit controls operation of the left motor controller;

wherein the logic circuit electrically connects to the right motor controller;

wherein the logic circuit controls operation of the right motor controller;

wherein the interface device is an electric circuit;

wherein the interface device forms the interface;

wherein the logic circuit receives the desired amount of counterforce generated by the load generating structure through the interface device;

wherein the left motor controller receives operating instructions from the logic circuit regarding the operation of the left electric motor of the left load generating substructure;

wherein the left motor controller electrically connects to the left electric motor;

wherein the left motor controller controls a direction of rotation of the left electric motor;

wherein the left motor controller controls a speed of rotation of the left electric motor;

wherein the left motor controller measures the amount of tension applied to the left cable by the left electric motor;

wherein the left motor controller adjusts the speed and direction of the rotation of the left electric motor to maintain a tension on the left cable that is consistent with the desired amount of counterforce;

wherein the right motor controller receives operating instructions from the logic circuit regarding the operation of the right electric motor of the right load generating substructure;

wherein the right motor controller electrically connects to the right electric motor;

wherein the right motor controller controls a direction of rotation of the right electric motor;

wherein the right motor controller controls a speed of rotation of the right electric motor;

wherein the right motor controller measures the amount of tension applied to the right cable by the right electric motor;

wherein the right motor controller adjusts the speed and direction of the rotation of the right electric motor to maintain a tension on the right cable that is consistent with the desired amount of counterforce.

* * * * *